United States Patent [19]

Nilsson

[11] Patent Number: 4,915,342

[45] Date of Patent: Apr. 10, 1990

[54] CHAIN ANCHOR CLAMP DEVICE

[75] Inventor: Lars-Erik Nilsson, St. Sundby, Sweden

[73] Assignee: Car-O-Liner Company, Wixom, Mich.

[21] Appl. No.: 255,666

[22] Filed: Oct. 11, 1988

[51] Int. Cl.[4] ..... B61D 45/00; B60P 7/08

[52] U.S. Cl. ..... 248/500; 248/680; 248/225.1; 410/105

[58] Field of Search ..... 248/500, 503, 506, 680, 248/681, 310, 499, 307, 225.1; 410/101, 104, 105, 116, 111

[56] References Cited

U.S. PATENT DOCUMENTS

| | | | |
|---|---|---|---|
| 2,688,289 | 9/1954 | Sterling | 410/104 |
| 3,381,925 | 5/1968 | Higuchi | 410/116 |
| 3,432,197 | 3/1969 | Albertine et al. | 248/499 X |
| 3,722,910 | 3/1973 | Heckenlaible | 410/104 X |
| 3,779,502 | 12/1973 | Marberg | 410/116 |
| 3,888,190 | 6/1975 | Bigge | 410/101 |
| 4,708,549 | 11/1987 | Jensen | 410/105 |

*Primary Examiner*—Ramon S. Britts
*Assistant Examiner*—Karen J. Chotkowski
*Attorney, Agent, or Firm*—Barnes, Kisselle, Raisch, Choate, Whittemore & Hulbert

[57] ABSTRACT

A chain anchor clamp device which secures a vehicle to a straightening bench during a chassis straightening operation. A chain anchor plate is pivotally mounted on a retainer cap releasably connected by bolts to a lock plate slidably receivable in tracks of the bench.

5 Claims, 3 Drawing Sheets

CHAIN ANCHOR CLAMP DEVICE

FIELD OF THE INVENTION

This invention relates to a vehicle attachment device for a vehicle chassis straightening or aligning bench, and more particularly to a moveable chain anchor clamp which secures a vehicle to the straightening bench.

BACKGROUND OF THE INVENTION

Straightening or alignment benches are used to repair damaged vehicle frames and bodies. But before any straightening operation can be carried out, the vehicle must be secured to the frame of the straightening bench by attachment devices. These attachment devices include chain anchor clamps which are fixed in various locations on the frame to secure chains connected to the vehicle frame.

The problem with such an arrangement is that vehicles are of all different sizes and lengths, and therefore, prior chain anchor clamps could not be located in the most convenient or advantageous position for securing a broad range of different vehicles.

SUMMARY OF THE INVENTION

A chain anchor clamp device having an anchor plate which pivots about a generally vertical axis, slides generally transversely and is releasably securable to a straightening bench in any desired pivoted position.

Objects, features and advantages of this invention are to provide a chain anchor clamp device for securing a chain connected to a vehicle to a straightening bench, which is capable of locking in any desired pivotal position and along the guide track, usable for many different vehicles, easy to set up and use, rugged, durable and of relatively simple and economical design, manufacture and assembly.

BRIEF DESCRIPTION OF THE DRAWINGS

These and other objects, features and advantages of this invention will be apparent from the following detailed description, appended claims and accompanying drawings in which:

DETAILED DESCRIPTION

Figures 1, 2:
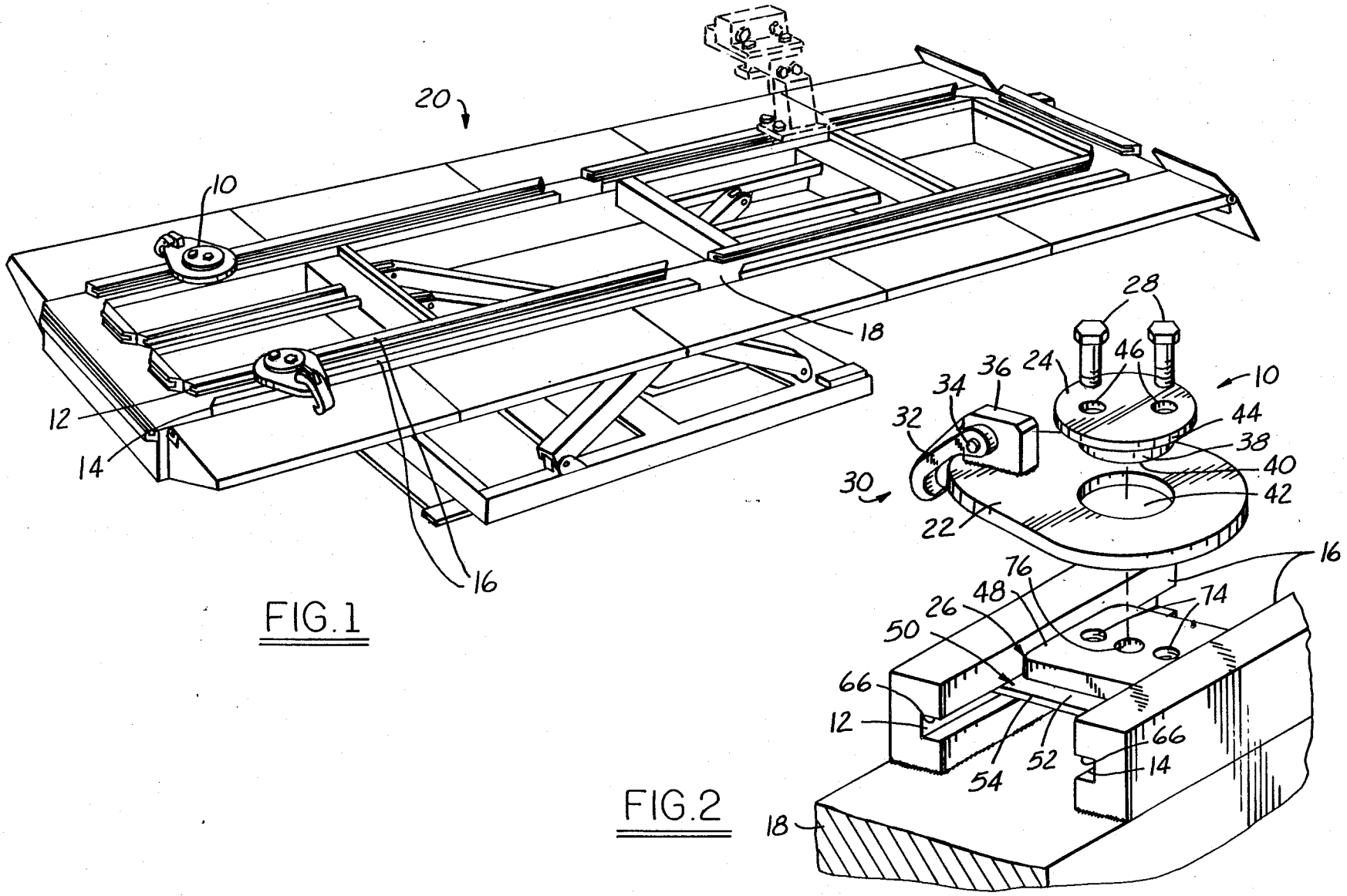
FIG. 1 is a perspective view of a chassis straightening or aligning bench with chain anchor clamp devices embodying this invention.
FIG. 2 is an exploded perspective view of a chain anchor clamp device of FIG. 1.

Referring in more detail to the drawings, FIGS. 1 and 2 illustrate a chain anchor clamp device 10 embodying this invention inserted into the recesses or grooves 12 and 14 in guide tracks 16 which are welded to the perimeter of the top surface of side beams 18 of a vehicle chassis straightening bench 20.

As shown in FIG. 2, clamp device 10 has an anchor plate 22 journaled for pivoting on a retainer cap 24 connected to a lock plate 26 by a pair of bolts 28. For engaging a chain, a hook 30 with a clevis 32 is pivotally connected by a pin 34 to a mounting block 36 fixed to the anchor plate. To facilitate positioning the hook relative to the vehicle, the anchor plate 22 is journaled for rotation on a cylindrical bearing 38 of a central hub 40 of the retainer 24 cap which is slidably received in a bore 42 through the anchor plate 22. The anchor plate 22 is retained on the hub 40 by a circumferentially continuous flange 44 of the cap 24.

In use, the chain anchor clamp device 10 is slidably received and releasably secured to the bench 20 by the cooperation of the retainer cap 24, lock plate 26 and bolts 28. The bolts 28 are received in guide bores 46 of the retainer cap 24 and engage lock plate 26. The lock plate 26 has a central prominence or island 48 receivable between a pair of opposed channels or tracks 16 of the bench and a peripheral flange or shoulder 50 which projects into the grooves 12 and 14 in the tracks.

Figure 3:
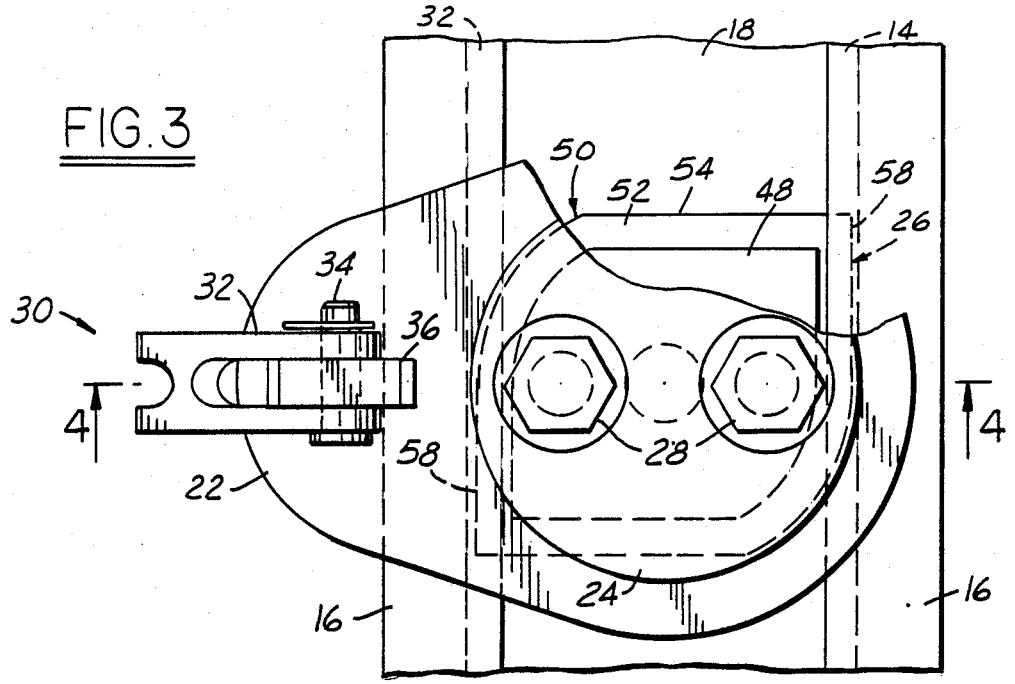
FIG. 3 is a top view of the chain anchor clamp device of FIGS. 1 and 2 with portions broken away for purposes of illustration.
Figure 6:
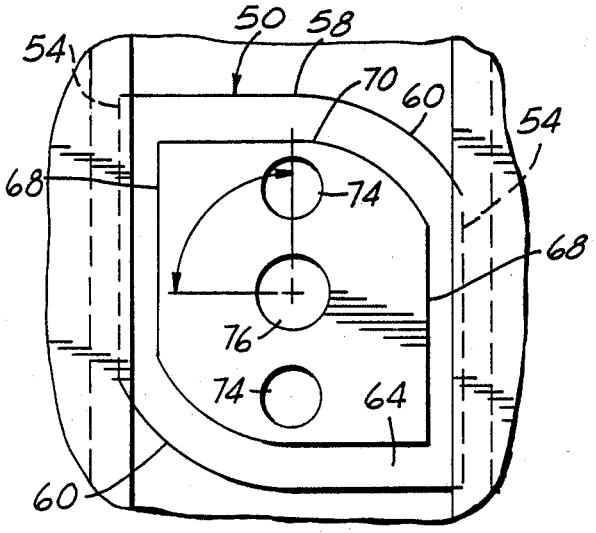
FIG. 6 is a fragmentary top view of the lock plate and track of FIG. 5.
Figure 5:
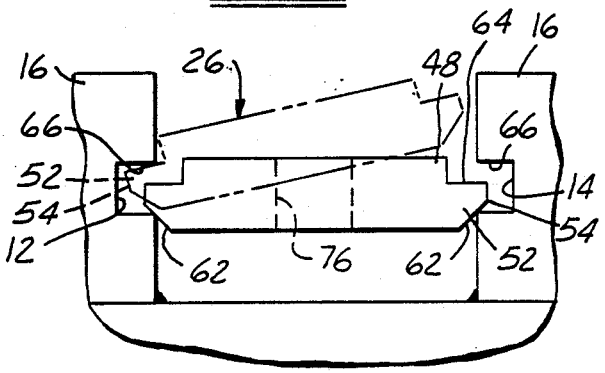
FIG. 5 a fragmentary end view of the vehicle chassis straightening bench of FIG. 1 with a lock plate inserted in the guide track with its position just before insertion shown in phantom.
Figure 7:
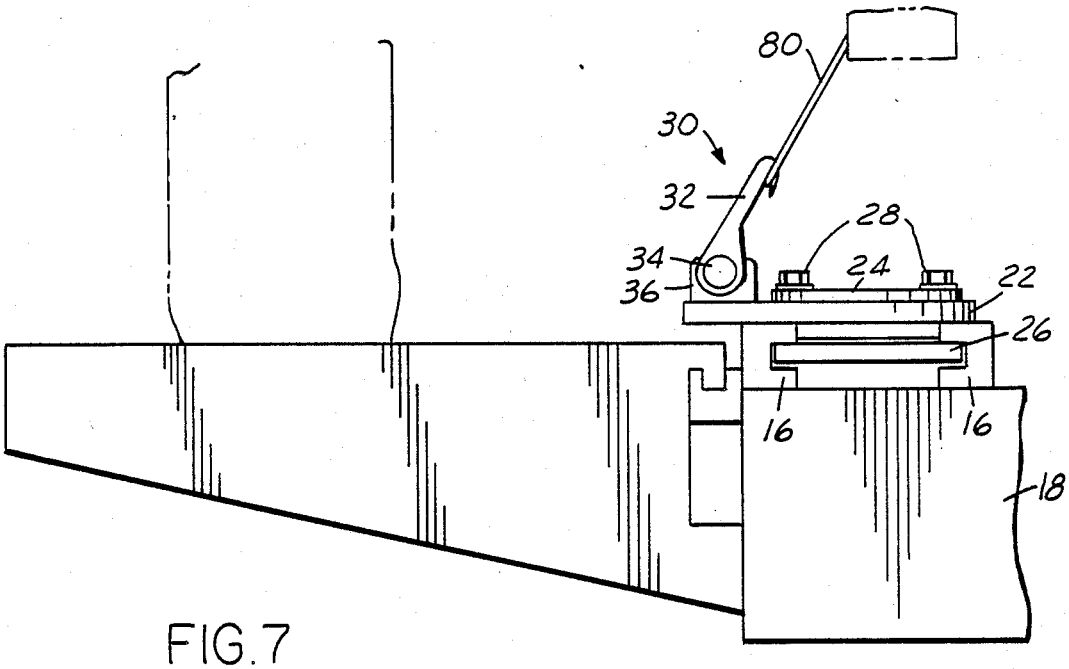
FIG. 7 is a fragmentary end view of the vehicle chassis straightening bench of FIG. 1 with the chain anchor clamp device securing a chain connected to a vehicle.
Figure 8:
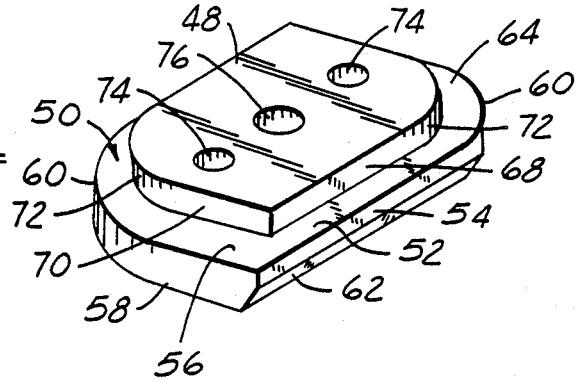
FIG. 8 is an enlarged perspective view of a loc plate of the chain anchor clamp device of FIG. 1.

Preferably, the lock plate 26 is constructed so that it can be inserted from above the tracks into their grooves 12 and 14 as shown in FIG. 5, and then rotated 90° from the position shown in FIG. 6 to that shown in FIG. 3 to fully engage the flange 50 in the grooves 12 and 14. This is accomplished by providing the flange 50 with a generally parallelogram shape with parallel guide flange portions 52 having side edges 54 which, as shown in phantom in FIG. 5, are transversely spaced apart so that when one flange portion 52 is inserted into a groove, the edge 54 of the opposite flange portion will slightly clear the inner face of the opposed track 16. Preferably, both guide flange portions 52 will project somewhat into the grooves 12 and 14 when the plate 26 is centered between the tracks 16.

Figure 4:
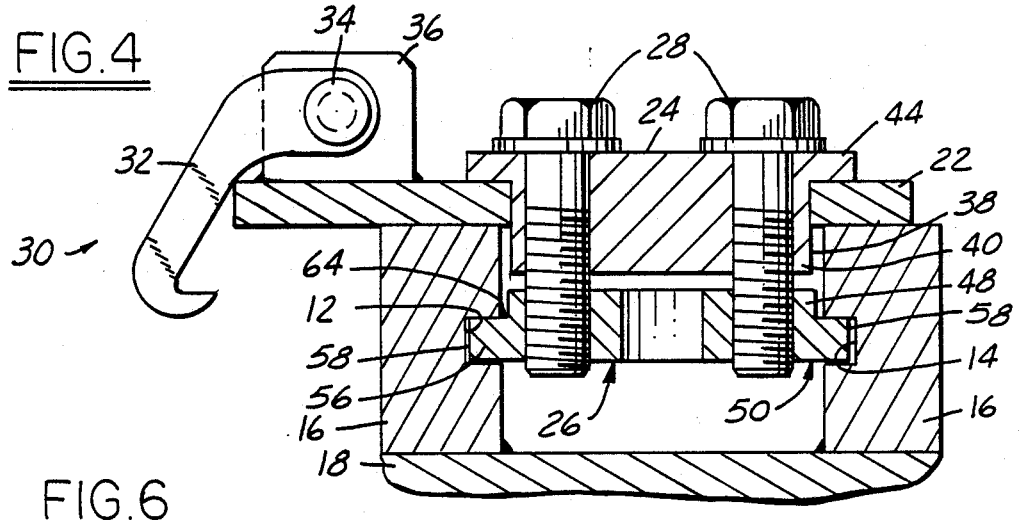
FIG. 4 is a sectional view taken along line 4—4 in FIG. 3.

As shown in FIG. 4, when the plate 26 is turned 90° to its locked position, a pair of parallel lock flange portions 56 have their edges 58 transversely spaced apart sufficiently so that they extend further into the grooves 12 and 14 with their edges 58 closely adjacent to the bottoms of the grooves 12 and 14. The transverse spacing between the edges 58 is greater than the transverse spacing between the edges 54.

To provide clearance for rotating the locking plate 26, the opposed corners 60 of edges 58 are rounded or curved. To facilitate insertion, locking and release of the plate 26, the lower edges 62 of the guide flanges 52 are beveled. As shown in FIG. 5, when the lock plate 26 is initially inserted in the grooves 12 and 14, it is centered between the tracks 16 by the beveled edges 62 and the upper face 64 of the flange 50 is spaced from the upper faces 66 of the grooves. On rotation of the plate 26 toward its locked position, the beveled edges 62 act as cams to lift the plate 26 so that the flange portions 56 are automatically aligned with and easily slide into the grooves 12 and 14 of the tracks 16, with the upper face 64 of the flange underlying the upper faces 66 of the grooves 12 and 14. The island 48 also has peripheral edges 68, 70 and 72 spaced inwardly of and complimentary to the peripheral edges 54, 58 and 60 of the flange 50.

When the anchor device 10 is received on the tracks 16 of the bench 20 and the lock plate 26 is turned to its locked position, as shown in FIGS. 3 and 4, it can be releasably secured to the bench 20 by tightening bolts 28 which are received in complimentary threaded holes 74 through the lock plate 26. The lock plate 26 has a center locating hole 76 through it to facilitate its machining from a block of steel. Preferably, although not necessarily, the centers of the threaded holes 74 are on a center line of the locater hole 76 parallel to one of the edges of the flange such as an edge 58 and are equally spaced from the center of the locater hole 76.

In operation, a vehicle is rolled onto the straightening bench 20 and chain anchor clamp devices 10 are installed into the guide tracks 16 beneath the vehicle. The clamp devices 10 are slid along the tracks 16 to the most convenient and advantageous position under the vehicle, then the lock plate 26 is rotated to its locked position by manually grasping the head of the bolts 28 and/or the retainer cap 24.

The anchor plate 26 can be rotated 360° about this advantageous position. Preferably, a chain 80 is then attached to the vehicle and hooked to the clevis 32 of the clamp device 10. Once set, the bolts 28 can be tightened down, drawing up the lock plate 26 and tightly engaging its upper flange surface 64 with the upper face 66 of the grooves 12 and 14. This also forces the retainer cap 24 onto the anchor plate 22 to hold it securely on the top of the guide tracks 16. This prevents the chain anchor clamp 10 from moving from the desired position.

If another position is desired, either angularly about the central hub 40 or linearly along the guide track 16, bolts 28 need only to be loosened or disassembled to relocate the clamp device 10. No dismantling of the clamp device 10 is necessary.

I claim:

1. A chain anchor clamp device for a vehicle straightening bench having a pair of opposed guide tracks, said clamp device comprising:

an anchor plate having a circular hole therethrough, a retainer cap having a cylindrical portion received in said hole through said anchor plate and journaling said anchor plate and retainer cap for relative rotation, a flange on said retainer cap overlying at least a portion of said anchor plate adjacent said hole and retaining said anchor plate on said retainer cap, a mounting block connected to said anchor plate and constructed and arranged for connecting a chain thereto;

a lock plate rotatable to a first position engaged in said guide tracks of said vehicle chassis straightening bench and to a second position disengaged and removable from said guide track, and securing means carried by said retainer cap and engaging said lock plate for rotation with said retainer cap and for releasably securing said anchor plate to the guide tracks, whereby a damaged vehicle can be held to said bench by a chain secured to said chain anchor clamp device when said lock plate is engaged in and said anchor plate secured to the guide tracks.

2. The chain anchor clamp device of claim 1 which also comprises a clevis pivotally connected by a pin to said mounting block, whereby a chain can be secured to said clevis of said chain anchor clamp device.

3. A chain anchor clamp device for a vehicle straightening bench having a pair of opposed guide tracks, said clamp device comprising:

an anchor plate;

a retainer cap retaining said anchor plate;

means journaling said anchor plate and retainer cap for relative rotation;

a fastening device connected to said anchor plate and constructed and arranged to secure a chain; and a lock plate engagable in said guide tracks of said vehicle chassis straightening bench, said lock plate having a central island receivable between said pair of opposed tracks of said bench, and a peripheral flange which projects into grooves of said opposed tracks, said peripheral flange is generally parallelogram shaped, has a pair of parallel guide flange portions with beveled lower edges and a pair of parallel lock flange portions having a transverse spacing greater than said guide flange portions, said lock plate being removable from said guide track, and means releasably securing said lock plate to said retainer cap so that said lock plate can be urged into locking engagement with the guide tracks, whereby a damaged vehicle can be held to said bench by a chain secured to said chain anchor clamp device when said lock plate is engaged in and secured to the guide tracks.

4. A chain anchor clamp device for a vehicle straightening bench having a pair of generally opposed channels, said clamp device comprising; an anchor plate, a mounting block fixed to said anchor plate, a retainer cap having a central hub on which said anchor plate and retainer cap are journaled for relative rotation and a circumferential flange which retains said anchor plate on said hub, a lock plate having a central island receivable between said pair of opposed channels of said bench and a peripheral flange which is generally parallelogram shaped and has a pair of parallel guide flange portions with beveled lower edges and a pair of parallel lock flange portions having a transverse spacing greater than said guide flange portions and a pair of rounded opposed corners, and securing means carried by said retainer cap and engaging said lock plate for releasably securing said anchor plate to the guide tracks.

5. The chain anchor clamp device of claim 4 which also comprises a clevis connected by a pin to said mounting block.

* * * * *